US011504831B2

(12) United States Patent
McKenzie

(10) Patent No.: US 11,504,831 B2
(45) Date of Patent: Nov. 22, 2022

(54) ORBITAL HAND WRENCH

(71) Applicant: Apex Brands, Inc., Apex, NC (US)

(72) Inventor: Timothy T. McKenzie, Westminster, MD (US)

(73) Assignee: APEX BRANDS, INC., Apex, NC (US)

( * ) Notice: Subject to any disclaimer, the term of this patent is extended or adjusted under 35 U.S.C. 154(b) by 202 days.

(21) Appl. No.: 16/642,115

(22) PCT Filed: Aug. 28, 2018

(86) PCT No.: PCT/US2018/048411
§ 371 (c)(1),
(2) Date: Feb. 26, 2020

(87) PCT Pub. No.: WO2019/046346
PCT Pub. Date: Mar. 7, 2019

(65) Prior Publication Data

US 2020/0198101 A1 Jun. 25, 2020

Related U.S. Application Data

(60) Provisional application No. 62/551,680, filed on Aug. 29, 2017.

(51) Int. Cl.

| | |
|---|---|
| ***B25B 23/00*** | (2006.01) |
| ***B25B 13/46*** | (2006.01) |
| ***B25B 13/48*** | (2006.01) |

(52) U.S. Cl.
CPC ..... *B25B 23/0028* (2013.01); *B25B 13/465* (2013.01); *B25B 13/481* (2013.01)

(58) Field of Classification Search
CPC .. B25B 23/0028; B25B 13/465; B25B 13/481
USPC ..... 81/177.75, 60
See application file for complete search history.

(56) References Cited

U.S. PATENT DOCUMENTS

| | | | | | |
|---|---|---|---|---|---|
| 69,399 | A | * | 10/1867 | Brown | B23B 45/12 408/121 |
| 2,092,345 | A | * | 9/1937 | Yuasa | B25G 1/063 81/63 |
| 4,274,309 | A | * | 6/1981 | Lenker | B23K 37/04 228/256 |

(Continued)

FOREIGN PATENT DOCUMENTS

| | | | |
|---|---|---|---|
| CN | 103659689 | A | 3/2014 |
| DE | 202016105210 | U1 | 9/2016 |
| GB | 2453008 | A | 3/2009 |

OTHER PUBLICATIONS

Office Action issued in corresponding Chinese application No. 201880056169.5 dated Dec. 2, 2020, all enclosed pages cited.

(Continued)

*Primary Examiner* — Hadi Shakeri
(74) *Attorney, Agent, or Firm* — Burr & Forman LLP

(57) ABSTRACT

An example hand wrench is provided. The hand wrench may include a handle (15) having a handle opening (12), and an orbital member (24) received within the handle opening. The orbital member may be configured to move orbitally about a point axis. The hand ratchet wrench may further include a driver affixed to the orbital member. The driver may be configured to receive a socket that interfaces with a fastener to turn the fastener.

13 Claims, 7 Drawing Sheets

(56) References Cited

U.S. PATENT DOCUMENTS

| | | | | |
|---|---|---|---|---|
| 4,549,872 | A * | 10/1985 | Kumpar | F16D 3/221 464/141 |
| 8,246,476 | B2 * | 8/2012 | Chen | B25B 13/481 464/141 |
| 8,375,830 | B1 | 2/2013 | Yang | |
| 8,671,808 | B2 * | 3/2014 | Huang | B25B 23/0028 81/177.75 |
| 9,669,525 | B2 * | 6/2017 | Tsai | B25G 1/105 |
| 9,962,815 | B2 * | 5/2018 | Zhang | B25B 13/461 |
| 10,076,829 | B2 * | 9/2018 | Sun | B25B 23/16 |
| 2011/0306431 | A1 * | 12/2011 | Rothe | F16D 3/70 464/139 |
| 2014/0060258 | A1 | 3/2014 | Anders | |
| 2016/0008962 | A1 | 1/2016 | Po-Yen | |
| 2016/0288303 | A1 | 10/2016 | William | |

OTHER PUBLICATIONS

International Search Report and Written Opinion from international application No. PCT/US2018/048411 filed on Aug. 28, 2018, all pages cited in it's entirety.

Office action from related Chinese application No. 201880056169.5 dated May 20, 2021, all pages cited.

* cited by examiner

ORBITAL HAND WRENCH

CROSS-REFERENCE TO RELATED APPLICATIONS

This application claims the benefit of U.S. provisional application No. 62/551,680 filed Aug. 29, 2017, the entire contents of which are hereby incorporated by reference.

TECHNICAL FIELD

Example embodiments generally relate to hand tools, and more particularly relate to hand wrenches.

BACKGROUND

Wrenches, including ratcheting wrenches, have become a standard hand tool in almost any tool box. However, many conventional wrenches can be limited in their applicability, particularly when a target fastener is difficult to access. Some wrenches offer an ability to pivot a handle to accommodate problematic environments. However, a common drawback of such solutions is that in many situations, the pivot handle wrench may be able to rotate a fastener only a very limited amount, if at all, due to, for example, interference and may only be able to interface with fasteners that are located directly in front of the wrench.

BRIEF SUMMARY OF SOME EXAMPLES

An example ratcheting hand wrench is provided. The example ratcheting hand wrench may comprise a handle including a handle opening and an orbital member received within the handle opening. The orbital member may be configured to move orbitally about a point axis to permit the wrench to engage fasteners that are located at an angle relative to the handle. The example ratcheting hand wrench may further comprise a ratchet assembly operably coupled to the orbital member. The ratchet assembly may be configured to rotate a drive in response to the handle being turned in a first rotational direction and ratchet without turning the drive in response to the handle being turned a second rotational direction.

According to another example embodiment, an example hand wrench is provided. The hand wrench may include a handle having a handle opening and an orbital member received within the handle opening. The orbital member may be configured to move orbitally about a point axis to permit the wrench to engage fasteners that are located at an angle relative to the handle. The hand ratchet wrench may further include a driver affixed to the orbital member. The driver may be configured to receive a socket that interfaces with a fastener to turn the fastener.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1A:
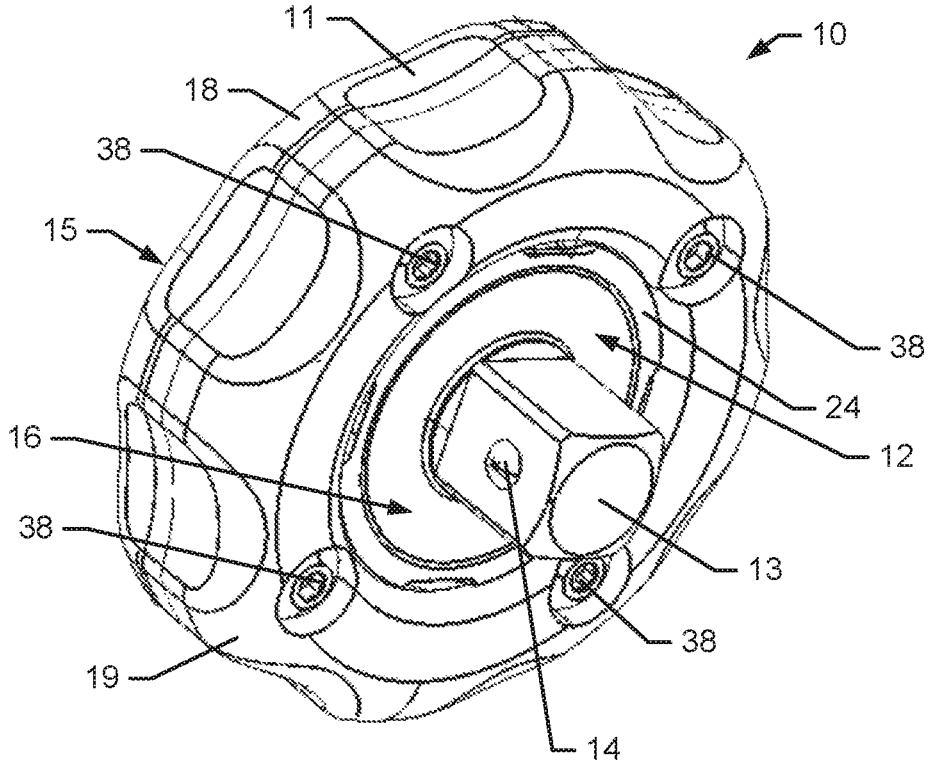
FIG. 1A shows a bottom side view of an orbital hand wrench in accordance with an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability, or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

According to various example embodiments, an orbital hand wrench is provided that may include a ratchet assembly. In this regard, the wrench may be comprised of a handle having an orbital member disposed within an opening of the handle. The orbital member may have an affixed socket drive that moves orbitally with orbital member relative to the handle, and also moves rotationally with the handle. In this regard, the orbital member and the socket drive may be movable within the handle about a point axis within a cone of available movement (i.e., the orbital member and the socket drive may be orbitally moveable). In situations where fasteners are disposed at locations that offer limited access and little or no room, the orbital movement of the drive can facilitate a user's ability to engage and turn the fastener. Additionally, a ratchet assembly may also offer the ability to turn the fastener without having to rotate the wrench in full revolutions or reposition the user's hand on the wrench during turning.

FIG. 1A shows a perspective view of a bottom side of an example orbital hand wrench 10, according to some example embodiments. The wrench 10 may comprise a handle 15, a ratchet assembly 16, and an orbital member 24. The handle 15 may have a toroidal shape with a plurality of finger indentations 11 on an exterior surface to provide grips for a user. According to some example embodiments, the handle 15 may be comprised of a first housing cover 18 (or upper housing cover) and a second housing cover 19. The first housing cover 18 may be secured to the second housing cover 19 via the fasteners 38, welds, adhesive, or the like.

The handle 15 may have a centrally located handle opening 12. The orbital member 24 may be received in the handle opening 12. In this regard, the orbital member 24 may be movable within the handle opening 12 in an orbital manner. The orbital member 24 may be permitted to pivot by at least an angular amount within a cone of movement (or move orbitally) relative to an axis point 36 (see FIGS. 5A and 5B) and the handle 15.

Figure 1B:
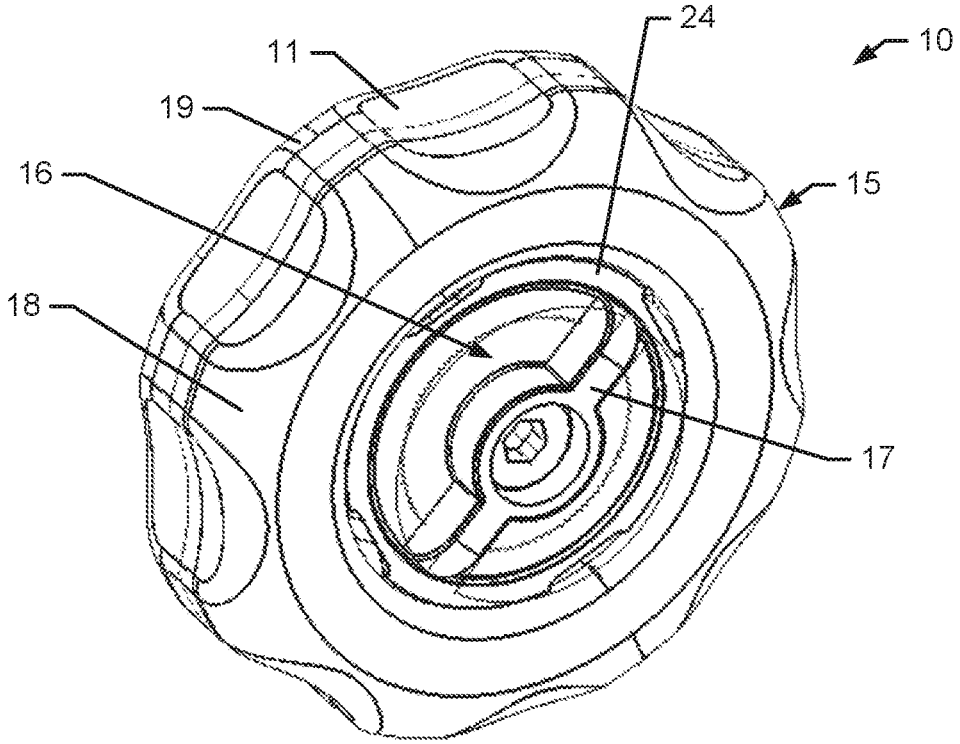
FIG. 1B shows a top side view of an orbital hand wrench in accordance with an example embodiment.

Further, the orbital member 24 may accommodate a ratchet assembly 16. The ratchet assembly 16 may be disposed in an orbital member opening 30, as described below. As such, movement of the orbital member 24 may operate to also move the ratchet assembly 16 in an orbital manner due to the ratchet assembly 16 being coupled to the orbital member 24. The ratchet assembly 16 may comprise a drive 13 (e.g., square socket drive) with, for example, a biased nub 14 disposed on a side of the drive 13 to hold a socket, socket extension, or the like onto the drive 13 during use of the wrench 10. A reversing switch 17 of the ratchet assembly 16 may be disposed on a top side of the wrench 10, as shown in FIG. 1B. The reversing switch 17 may control a rotational direction (e.g., clockwise or counterclockwise) that the handle 15 rotates the drive 13 and ratchets the handle 15.

Figure 2A:
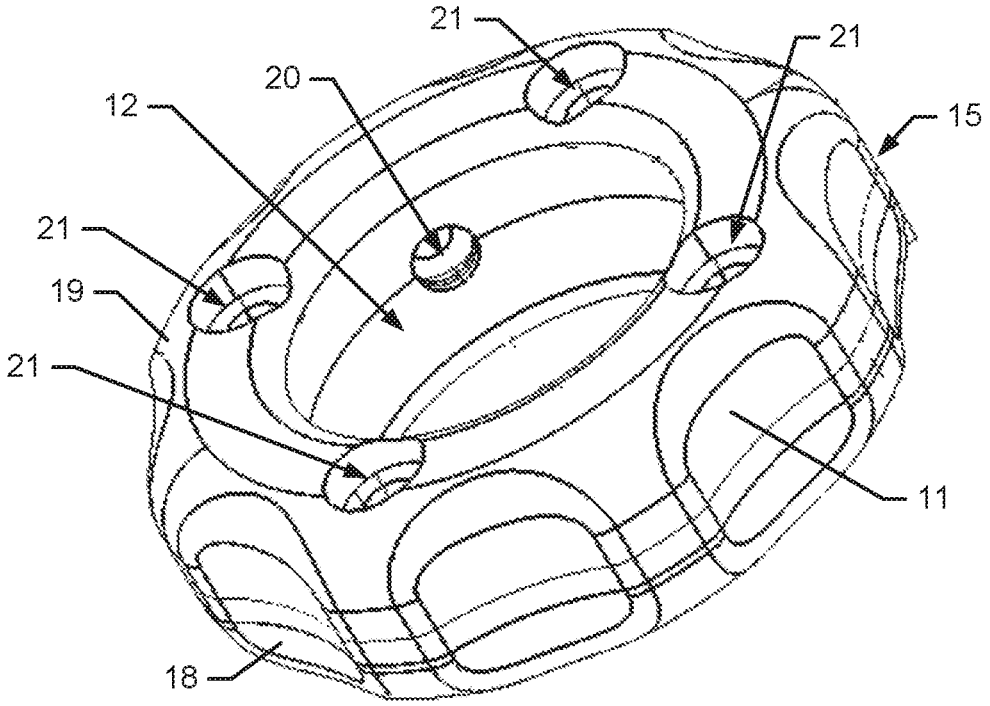
FIG. 2A shows a handle for an orbital hand wrench in accordance with an example embodiment.

An isolated perspective bottom view of the handle 15 is provided in FIG. 2A. In this regard, with the orbital member 24 removed, the handle opening 12 and the toroidal shape of the handle 15 can be seen. Additionally, an engaging member cavity 20, as further described below, is also shown. Fastener cavities 21 in the second housing cover 19, which are configured to receive respective fasteners 38, are also shown. The fastener cavities 21 may pass through the second housing cover 19 and into the first housing cover 18 and may be threaded.

Figure 2B:
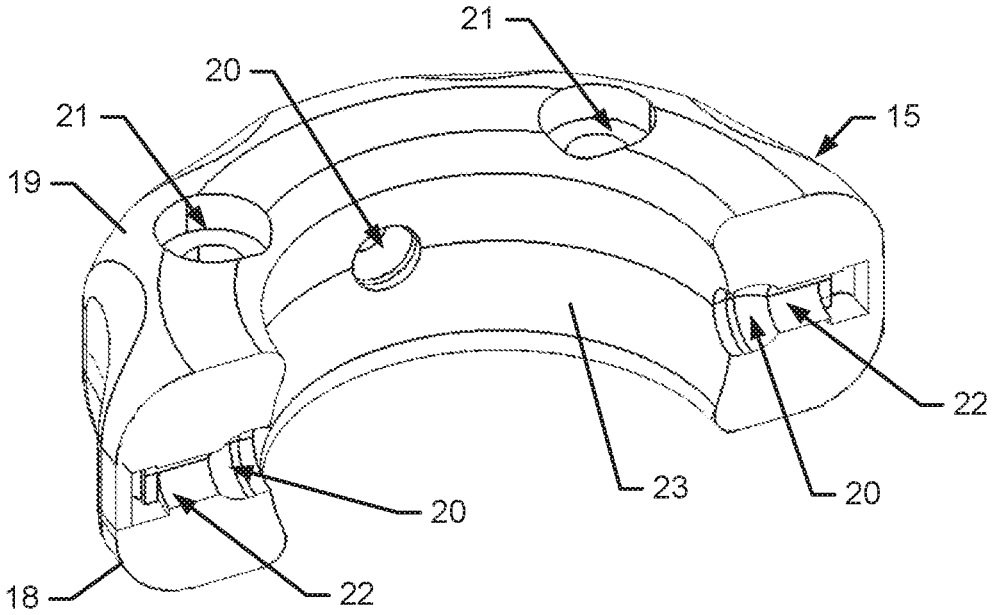
FIG. 2B shows a cross-section of a handle of an orbital hand wrench in accordance with an example embodiment.

FIG. 2B shows a perspective cross-section view of the handle 15. In this regard, the handle 15 may include engaging member cavities 20 on an inner surface 23 of the handle 15. An engaging member cavity 20 may be formed to partially receive an engaging member 26. In this regard, according to some example embodiments, an engaging member cavity 20 may have rounded walls for receiving an engaging member 26 that may take the form of a sphere. The handle 15 may also include biasing member cavities 22 that are adjacent to a respective engaging member cavity 20 and extend into the handle 15 from behind a respective engaging member cavity 20. The biasing member cavities 22 may be narrower in width than the engaging member cavities 20 to receive and constrain the movement of a biasing member 25 to move in the direction towards the engaging member 26.

Figure 2C:
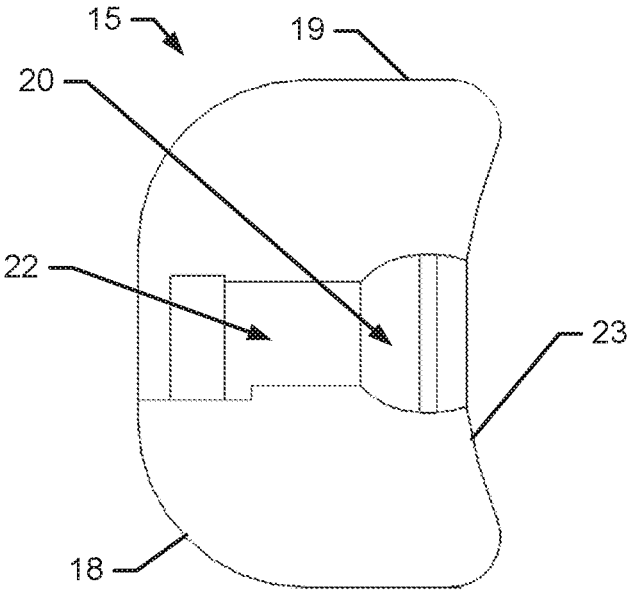
FIG. 2C shows a cross-section of one portion of a handle of an orbital hand wrench in accordance with an example embodiment.

FIG. 2C provides a more detailed view of a partial cross-section of the handle 15. The inner surface 23 of the handle 15 may be curved at a given radius of curvature in a concave manner to accommodate an external convex surface of the orbital member 24. As such, the curvature of the inner surface 23 of the handle 15 may compliment the curved external surface 27 of the orbital member 24 (see FIG. 4A). The complimentary relationship between the inner surface 23 of the handle 15 and the external surface 27 of the orbital member 24 may facilitate the orbital movement ability of the orbital member 24 and permit pivoting of the orbital member 24 within the handle opening 12. Further, the engaging member cavity 20 may be shaped such a portion of, for example, a spherical shaped engaging member 26 may extend into the handle opening 12 to contact the orbital member 24 as further described below.

Figure 3:
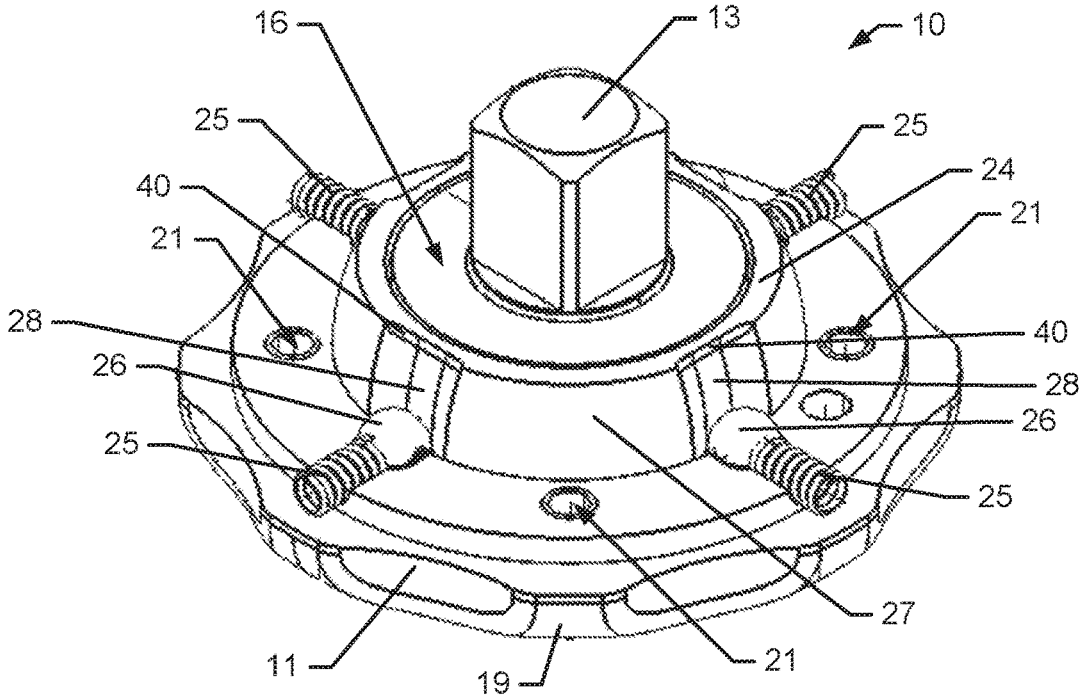
FIG. 3 shows an orbital hand wrench with a housing cover removed in accordance with an example embodiment.

FIG. 3 shows wrench 10 with the first housing cover 18 removed, according to some example embodiments. This view reveals the details of the interaction between the handle 15 and the orbital member 24 to facilitate orbital movement of the orbital member 24 relative to the handle 15. In this regard, the orbital member 24 may be suspended within the handle opening 12 by a plurality of biased engaging members 26 (e.g., four engaging members 26) that impose respective forces towards a center of the orbital member 24 and the handle opening 12. As mentioned above, the engaging members 26 may partially extend out of their respective engaging member cavity 20 in the handle 15 and into the handle opening 12 to contact the orbital member 24. While the example wrench 10 is described here with four engaging members 26, it is contemplated that any number of engaging members 26 may be used to moveably suspend the orbital member 24 within the handle opening 12. A biasing member 25 (e.g., coiled spring) received in a biasing member cavity 22 may apply a force on the engaging member 26 into the handle opening and towards a center of the handle opening 12. The engaging member 26 may have, according to some example embodiments, a spherical or partially spherical shape, and may therefore be, for example, a ball bearing. In this regard, a rounded surface of the engaging member 26 may apply a holding force directly on the orbital member 24, and more specifically on a surface of a channel 28 of the orbital member 24. Due to the rounded surface of the engaging member 26, a surface area of the engaging member 26 that contacts the channel 28 may be relatively small thereby limiting the friction between the engaging member 26 and the channel 28 during movement of the engaging member 26 within the channel 28. Further, during movement of the engaging member 26 within the channel 28, the engaging member 28 may roll, thereby further limiting the friction between the engaging member 26 and the channel 28 to facilitate ease of orbital movement of the orbital member 24 relative to the handle 15.

Each channel 28 may include a channel stop 40 at the vertical ends of the channel 28 to maintain the engaging member 26 in the channel 28. From FIG. 3, it can be seen that, according to some example embodiments, an external surface 27 of the orbital member 24 may be convex. According to some example embodiments, the orbital member 24 may be at least partially spherical. Further, despite being cut out of the curved external surface 27 of the orbital member 24, a floor of the channel 28 may also be curved in a convex manner.

Figure 4A:
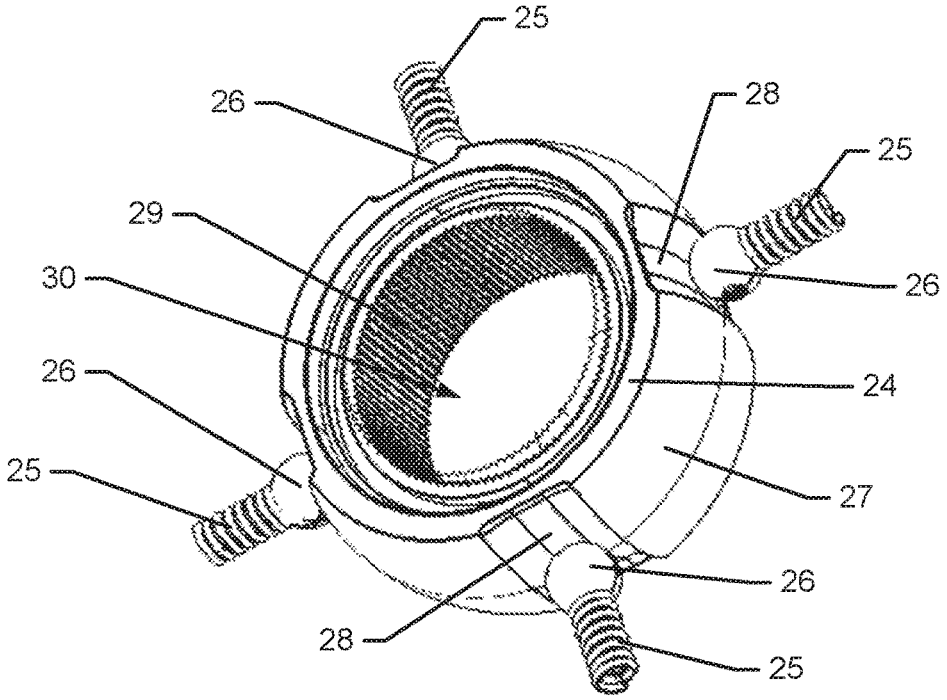
FIG. 4A shows an orbital member in contact with engaging members in accordance with an example embodiment.

FIG. 4A shows the orbital member 24 in engagement with the engaging members 26 and the biasing members 25, in the absence of other components of the wrench 10. In this regard, a portion of the ratchet assembly 16 has been removed. The orbital member 24 may have an orbital member opening 30. An internal surface of the orbital member opening 30 may include ratchet teeth 29 encircling the orbital member opening 30, which may operate as a component of the ratchet assembly 16. The ratchet teeth 29 may engage with a movable pawl 39 (see FIGS. 6A and 6B) to facilitate a ratcheting function of the wrench 10.

Figure 4B:
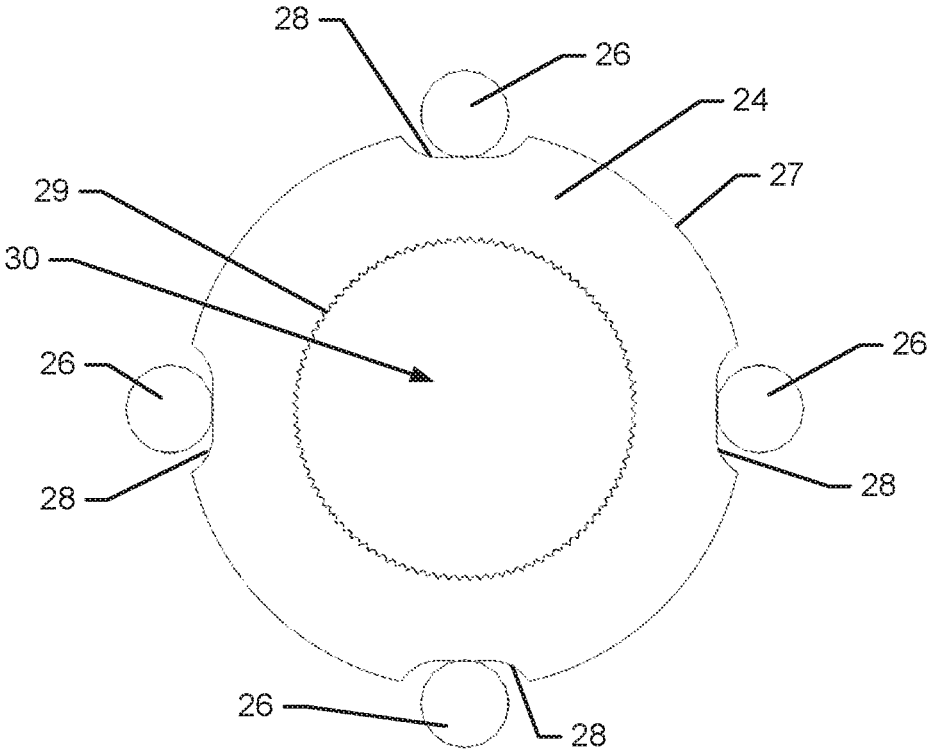
FIG. 4B shows a cross-section of the orbital member in contact with engaging members in accordance with an example embodiment.
Figure 4C:
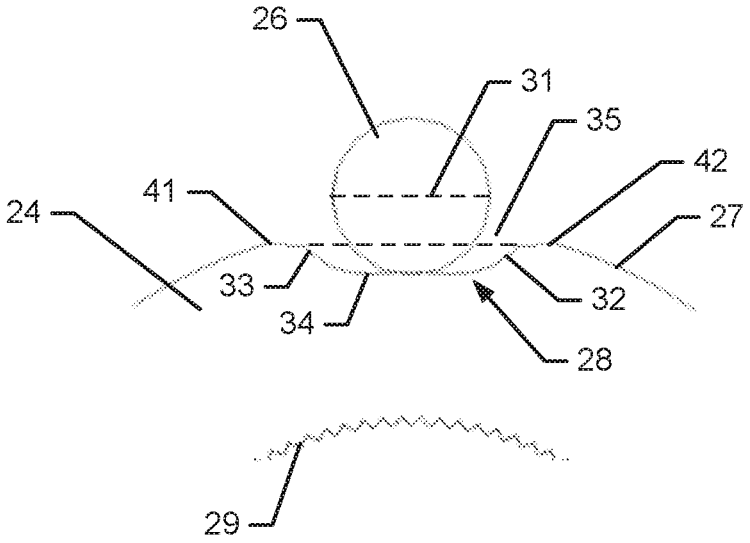
FIG. 4C shows a magnified view of the cross-section of the orbital member in contact with an engaging member in accordance with an example embodiment.

FIGS. 4B and 4C provide additional views of internal components of wrench 10. In this regard, FIG. 4B is a cross-section view of the orbital member 24 in contact with the engaging members 26, where the engaging members 26 are disposed within the channels 28 of the orbital member 24. For example, according to some example embodiments, a total of four engaging members 26 may contact the orbital member 24 in respective channels 28, although any number of engaging members 26 could be used.

With respect to FIG. 4C, a magnified view of a single engaging member 26 in a channel 28 is shown. In this regard, the channel 28 may have a floor 34 and sidewalls 32, 33. The sidewalls 32, 33 may be curved to permit the engaging member 26 to move or roll within the channel 18 into contact with, for example, the sidewalls 32, 33, which may operate to limit the movement of the engaging member 26 in a lateral direction. In this regard, a width 35 of the channel 28 may be larger than a width 31 of the engaging member 26 to permit such lateral movement within the channel 28. Accordingly, since the channel 28 may be both longer and wider than the engaging member 26, the engaging member 26 may move or roll within the channel 28 in both the lateral and vertical directions. Further, transitional surfaces in the form of chamfers 41, 42 may also be provided at the side edges of the channel 28. The chamfer 41, 42 may allow the engaging member 26, when the wrench 10 is under high torque, to deform the sidewalls 32, 33 causing the material of the sidewall to raise without creating and interference with the inner surface 23 of the handle 15. Movement of the engaging member 26 in the vertical direction may be constrained within in the channel 28 by the channels stops 40. The ability to permit the constrained movement of the engaging member 26 within the channel 28 in both the lateral and vertical directions may be necessary to permit the orbital movement of the orbital member 24 relative to the point axis 36 and the handle 16.

Figure 5A:
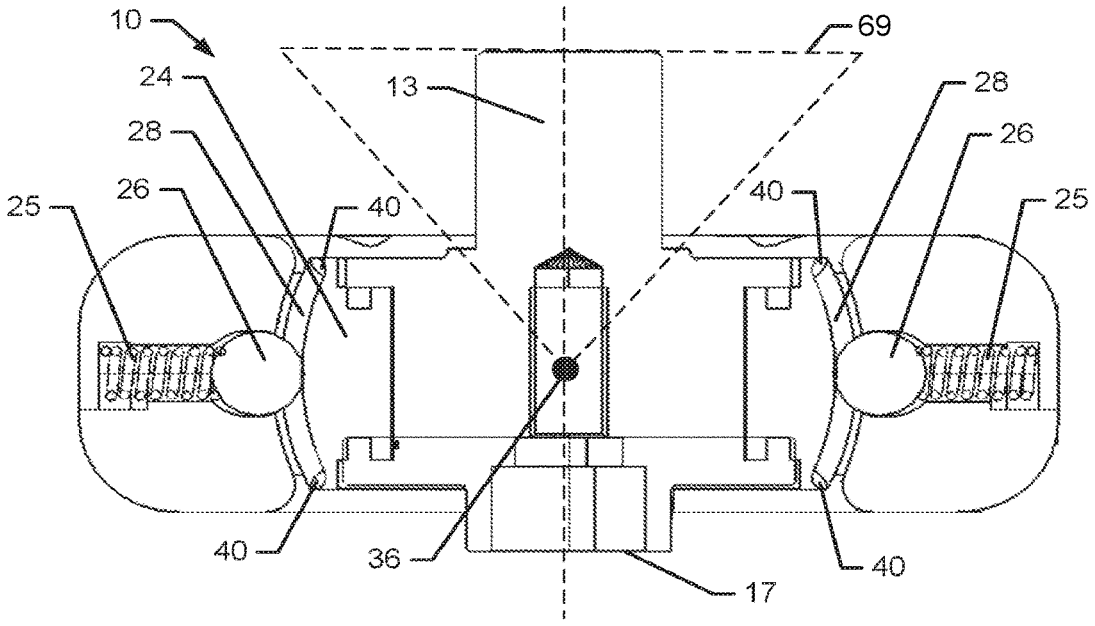
FIG. 5A shows a cross-section view of the orbital hand wrench in association with a cone of available movement in accordance with an example embodiment.

FIG. 5A shows a cross-section view of the wrench 10 with a representation of the cone of available movement 69 for the drive 13. In this regard, the orbital member 24 may pivot about the point axis 36 in any direction to predetermined maximum angle that may be set by the positioning of the channel stops 40. Since the orbital member 24 is able to pivot in a three-dimensional space, the orbital movement of the orbital member 24 and the drive 13 may define a cone of available movement for the drive 13. As mentioned earlier, the movement of the orbital member 24 and the drive 13 may be limited by the channel stops 40 which may prevent further orbital movement of the orbital member 24 and the drive 13 beyond a particular maximum angle and prevent the orbital member 24 from sliding out of the handle opening 12.

Figure 5B:
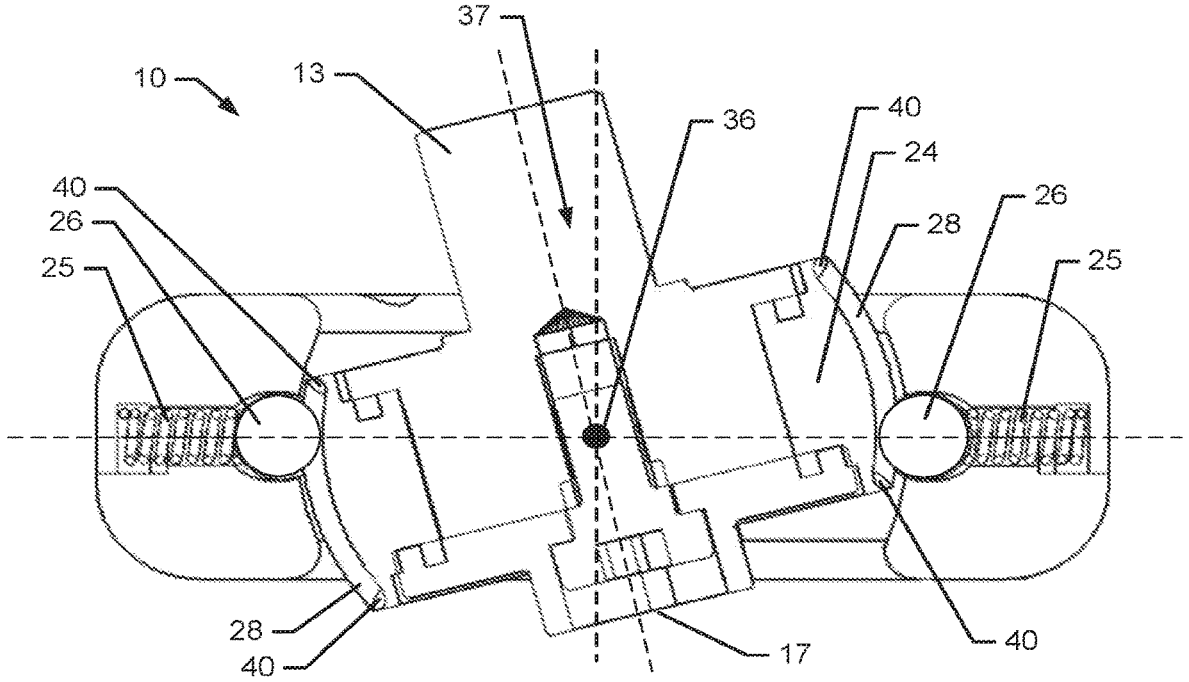
FIG. 5B shows a cross-section view of the orbital hand wrench with an orbital member and a drive in a pivoted position in accordance with an example embodiment.

In this regard, FIG. 5B shows the wrench 10 with the orbital member 24 and the drive 13 pivoted from a center position by an angle 37. As can be seen, the engaging members 26 have moved relative the orbital member 24 within the respective channels 28. Accordingly, due to the pivoting, orbital movement of the orbital member 24 and the drive 13, as shown, for example in FIG. 5B, the wrench 10 may be able to engage with a fastener that is not aligned with a center of the wrench 10, but angularly offset form a center of the wrench 10 thereby providing a wrench 10 with positional flexibility, particularly in limited access environments.

Figure 6A:
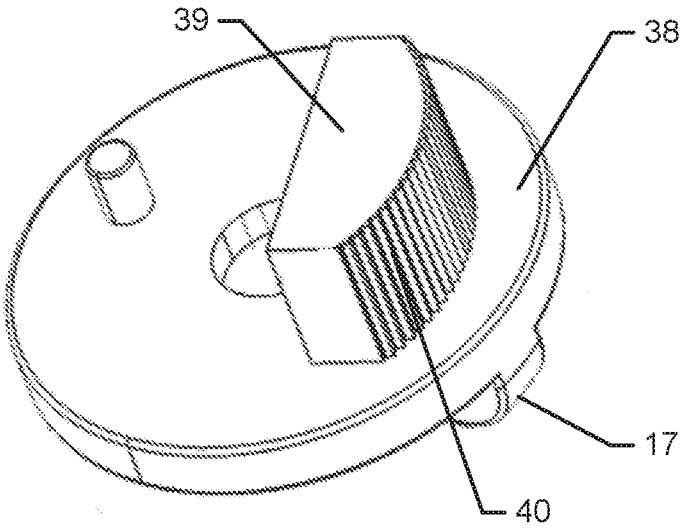
FIGS. 6A and 6B show components of a ratchet assembly in accordance with an example embodiment.
Figure 6B:
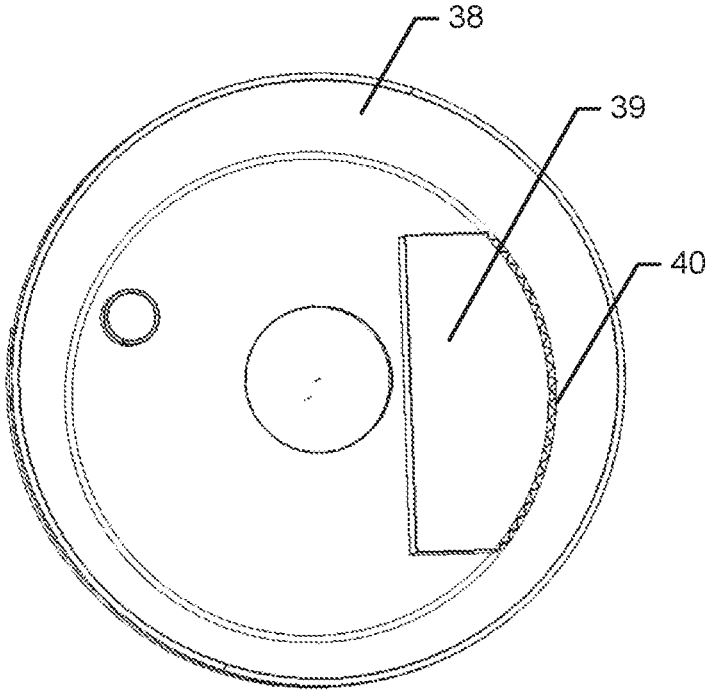

FIGS. 6A and 6B show further components of the ratchet assembly 16. In this regard, the ratchet assembly may be operably coupled to the orbital member 24, as described above, and the ratchet assembly 16 may be configured to rotate the drive 13 in response to the handle 15 being turned in a first rotational direction and ratchet without turning the drive 13 in response to the handle 15 being turned a second rotational direction. The rotational direction that turns the drive 13 may be determined by the position of the reversing switch 17. In this regard, the operation of the ratchet assembly 16 may be controlled by a position of the pawl 39. As can be seen best in FIG. 6B, the pawl 39 may be offset from a center point of the pawl support plate 38. The reversing switch 17 may be affixed to an opposite side of the pawl support plate 38. Further, rotation of the reversing switch 17 may operate to translate the pawl 39 into a position to contact the ratchet teeth 29 of the orbital member 24 to either permit ratcheting in a first or a second rotational direction.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A ratcheting hand wrench comprising:

a handle having a toroidal shape with closed continuous inner and outer surfaces defining a central handle opening and comprising a plurality of engaging member cavities and a plurality of biasing member cavities located around the central handle opening;

an orbital member received within the central handle opening, the orbital member being configured to move orbitally about a point axis, a curvature of an external surface of the orbital member being complementary to the inner surface of the handle opening, the orbital member comprising an opening, an internal surface of the orbital member includes ratchet teeth encircling the orbital member;

a driver affixed to the orbital member and operationally coupled to the ratchet teeth, the driver being configured to move with the orbital member within a cone of available movement relative to the handle;

a ratchet assembly operably coupled to the orbital member, the ratchet assembly configured to rotate a drive in response to the handle being turned in a first rotational direction and ratchet without turning the drive in response to the handle being turned a second rotational direction;

a plurality of biasing members respectively disposed within the plurality of biasing member cavities;

a plurality of engaging members respectively disposed within the plurality of engaging member cavities;

wherein each biasing member applies a force on a respective engaging member directed into the central handle opening such that the engaging member contacts and applies a force on the orbital member; and wherein the orbital member includes a plurality of channels; and wherein each engaging member is received within a respective channel of the plurality of channels and each engaging member is configured to be movable within the respective channel and relative to the orbital member when the orbital member moves orbitally about the point axis.

2. The ratcheting hand wrench of claim 1, wherein sidewalls of each of the channels are at least partially curved and wherein each engaging member has a curved surface that contacts the orbital member.

3. The ratcheting hand wrench of claim 1, wherein a width of each of the channels is larger than a width of each of the engaging members.

4. The ratcheting hand wrench of claim 1, wherein each of the channels include channel stops and wherein the channel stops prevent the engaging members from moving out of the channels.

5. The ratcheting hand wrench of claim 1, wherein the outer surface of the orbital member is convex.

6. The ratcheting hand wrench of claim 1, wherein the the inner surface of the handle opening is concave.

7. The ratcheting hand wrench of claim 1, wherein the ratchet assembly further comprises a movable pawl having pawl teeth, wherein at least a portion of the pawl teeth engage with the ratchet teeth of the orbital member.

8. A hand wrench comprising:

a handle having a toroidal shape with closed continuous inner and outer surfaces defining a central handle opening and comprising a plurality of engaging member cavities and a plurality of biasing member cavities located around the central handle opening;

an orbital member received within the central handle opening, the orbital member being configured to move orbitally about a point axis, a curvature of an external surface of the orbital member being complementary to the inner surface of the handle opening, the orbital member comprising an opening, an internal surface of the orbital member includes teeth encircling the orbital member;

a driver affixed to the orbital member and operationally coupled to the teeth, the driver being configured to move with the orbital member within a cone of available movement relative to the handle;

a plurality of biasing members respectively disposed within the plurality of biasing member cavities;

a plurality of engaging members respectively disposed within the plurality of engaging member cavities;

wherein each biasing member applies a force on a respective engaging member directed into the central handle opening such that the engaging member contacts and applies a force on the orbital member;

wherein the orbital member includes a plurality of channels; and wherein each engaging member is received within a respective channel of the plurality of channels and each engaging member is configured to be movable within the respective channel and relative to the orbital member when the orbital member moves orbitally about the point axis.

9. The hand wrench of claim 1, wherein the channel includes a first sidewall and a second sidewall, wherein the first sidewall and the second sidewall are at least partially curved and wherein the engaging member has a curved surface that contacts the orbital member.

10. The hand wrench of claim 1, wherein a width of the channel is larger than a width of the engaging member.

11. The hand wrench of claim 1, wherein the channel includes channel stops at each end of the channel and wherein the channel stops prevent the engaging member from moving out of the channel.

12. The hand wrench of claim 8, wherein the outer surface of the orbital member is convex.

13. The hand wrench of claim 12, wherein the inner surface of the handle opening is concave.

* * * * *